United States Patent [19]

Yamanaka et al.

[11] Patent Number: 4,580,625

[45] Date of Patent: Apr. 8, 1986

[54] AUTOMOTIVE OIL COOLER

[75] Inventors: Yasutoshi Yamanaka, Kariya; Takeshi Mizutani, Chiryu, both of Japan

[73] Assignee: Nippondenso Co., Ltd., Kariya, Japan

[21] Appl. No.: 598,590

[22] Filed: Apr. 10, 1984

[30] Foreign Application Priority Data

Apr. 13, 1983 [JP] Japan ..... 58-66238

[51] Int. Cl.[4] ..... F28F 3/08

[52] U.S. Cl. ..... 165/167; 165/DIG. 916

[58] Field of Search ..... 165/166, 167, 165, DIG. 23; 123/41.33

[56] References Cited

U.S. PATENT DOCUMENTS

| | | | |
|---|---|---|---|
| 3,743,011 | 7/1973 | Frost | 165/167 X |
| 4,058,980 | 11/1977 | Ahlen | 165/166 X |
| 4,271,901 | 6/1981 | Buchmüller | 165/166 X |
| 4,360,055 | 11/1982 | Frost | 165/167 X |

FOREIGN PATENT DOCUMENTS

| | | | |
|---|---|---|---|
| 1539863 | 2/1979 | United Kingdom | 165/167 |

*Primary Examiner*—Sheldon J. Richter

*Attorney, Agent, or Firm*—Cushman, Darby & Cushman

[57] ABSTRACT

Each of heat exchanging units which constitute a heat exchanger is composed of a first plate and a second plate respectively provided with a through hole, an inlet hole and a communication hole and formed with crowns adapted to form a space through which a second fluid flows, a collar and a ring, both surfaces of which are placed in contact with inner surfaces of both first and second plates, are interposed between the first and second plates to form a space through which a first fluid flows. The collar is disposed being axially aligned with a flange portion of the through bolt extending through the heat exchanging units whereby the load resistance of the heat exchanging units can be increased. Moreover, with this arrangement, the heat exchanging units may be easily stacked.

7 Claims, 15 Drawing Figures

AUTOMOTIVE OIL COOLER

BACKGROUND OF THE INVENTION

The present invention relates to a heat exchanger, which is effectively used, for example, for an oil cooler wherein engine oil and engine cooling water in the engine for an automobile are heat exchanged to cool the engine oil.

A conventional oil cooler of this general type is disclosed in Japanese Patent Laid-Open No. 103241/1974, in which the oil cooler is interposed between an engine block and an oil filter to cool engine oil before the oil flows into the oil filter. However, this known arrangement has a drawback in that when the oil cooler of this type is mounted on the engine block and when the oil filter is mounted on the oil cooler, a great load is applied axially of the oil cooler, as a consequence of which heat exchanging units which constitute the oil cooler become collapsed.

SUMMARY OF THE INVENTION

It is a primary object of the present invention to materially enhance the load resistance of the heat exchanging units of the heat exchanger and to improve the laminated state of the heat exchanging units to enhance their durability.

The present invention provides an arrangement wherein each of the heat exchanging units comprises a first plate and a second plate which plates are respectively provided with a through hole, an inlet hole, a communication hole and integrally formed crowns, and a collar and a ring whose both surfaces come into contact with the inner surface of the first plate and the inner surface of the second plate are interposed between the first plate and the second plate.

The collar is disposed being axially alinged with a flange of a through bolt which is fitted into the through hole whereby a load applied to the heat exchanger through the through bolt is applied directly to the collar.

When the heat exchanging units are laminated, the crowns integrally formed on the first plate and the second plate are brought into contact with each other to form a space through which a second fluid passes.

A member for forming the space through which the second fluid passes is not interposed between the heat exchanging units.

DETAILED DESCRIPTION OF THE PREFERRED EMBODIMENTS

Figure 1:
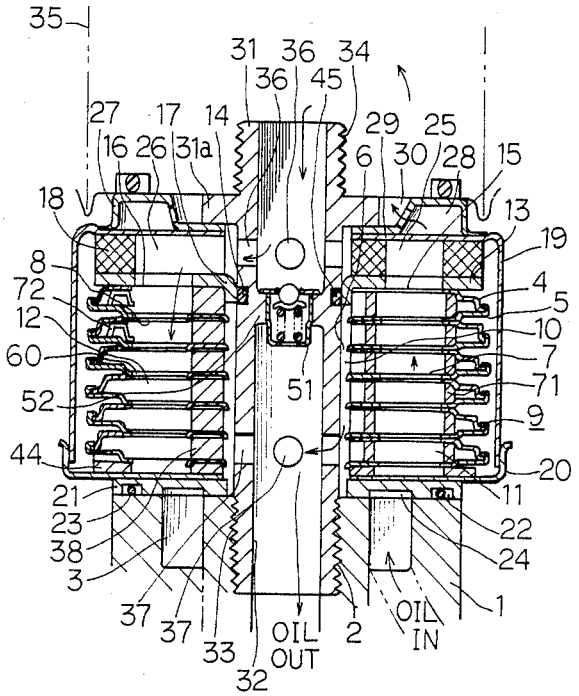
FIG. 1 is a sectional view taken on line I—I of FIG. 2 showing one embodiment of a heat exchanger in accordance with the present invention.
Figure 11:
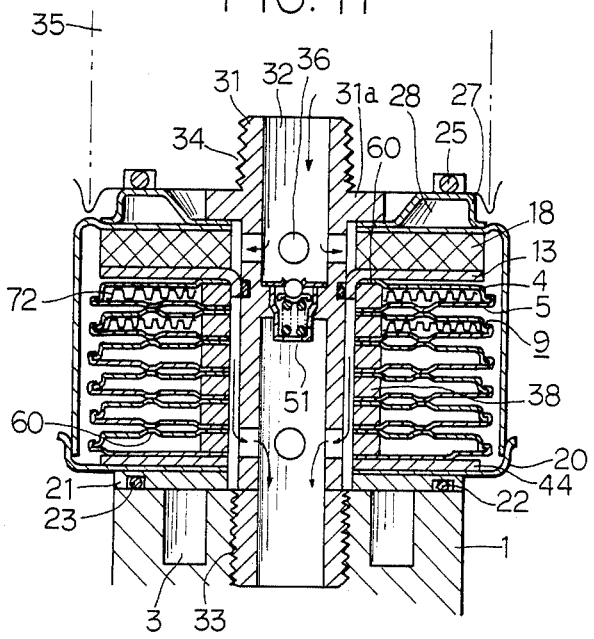
FIG. 11 is a sectional view taken on line XI—XI of FIG. 2.
Figure 15:
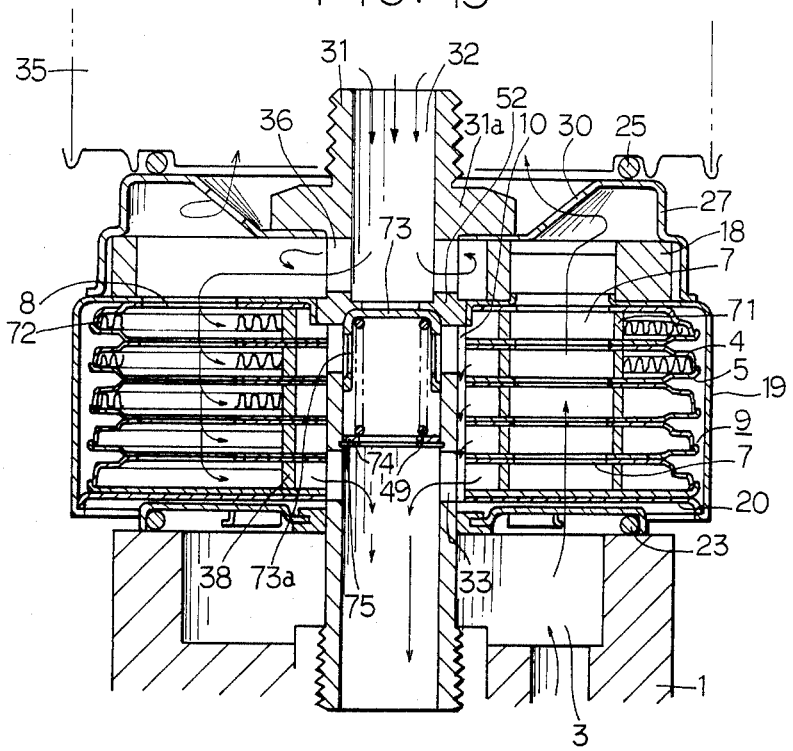
FIG. 15 is a sectional view showing another embodiment of the heat exchanger.

One embodiment of the present invention will now be described with reference to the drawings. In FIGS. 1 and 11, a reference numeral 1 designates an engine block for the engine of an automobile. In this engine block 1, a tapped hole 2 for mounting a heat exchanger i.e. an oil cooler is disposed in the inner portion of an annular oil flowpassage 3 of the engine block 1.

Figure 6:
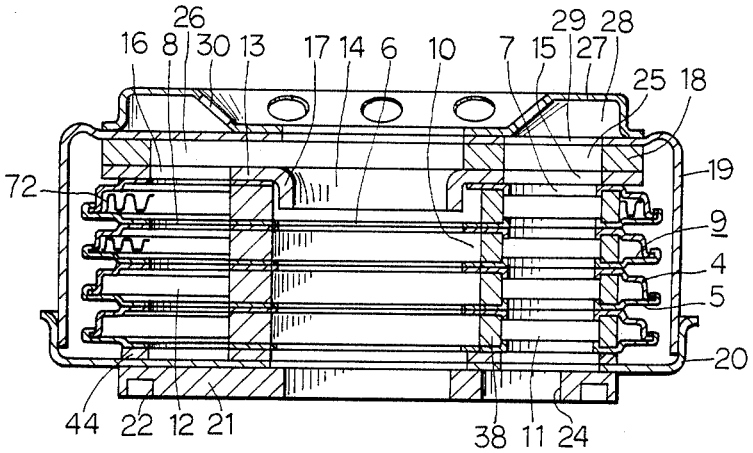
FIG. 6 is a sectional view showing the state wherein heat exchanging units are assembled.
Figure 12:
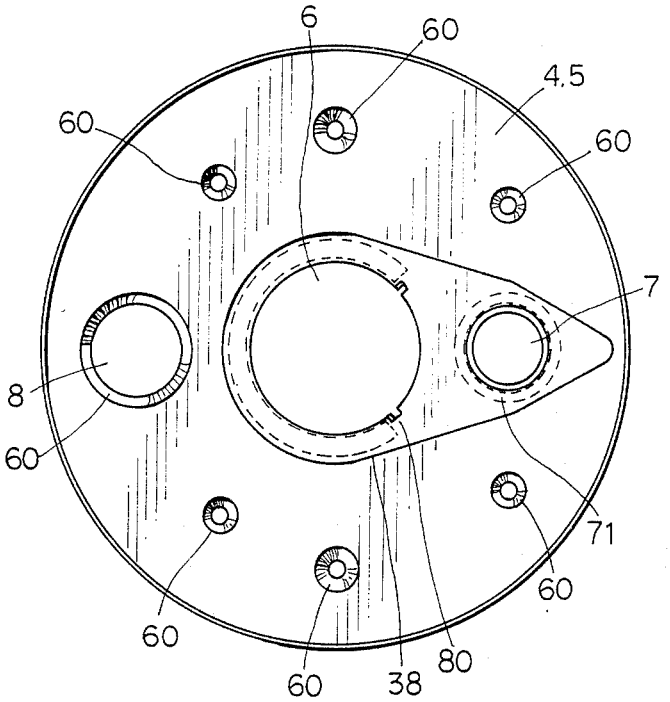
FIG. 12 is a front view showing a first or secont plate.
Figure 13:
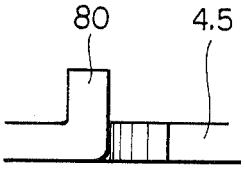
FIG. 13 is a sectional view showing a bent portion of the first or second plate.
Figure 14:
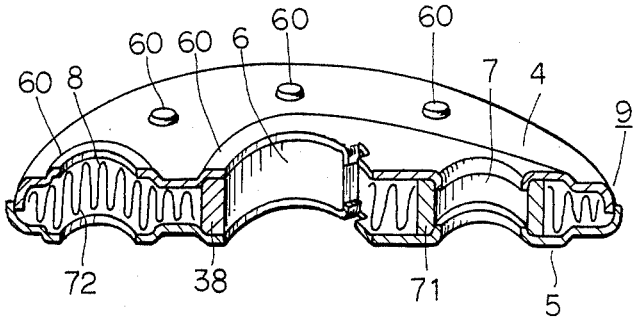
FIG. 14 is a perspective sectional view of a heat exchanger unit of the heat exchanger.

A reference numeral 4 designates a first plate made of stainless having a wall thickness of approximately 0.4 mm, and 5 designates a second plate likewise made of stainless having a wall thickness of approximately 0.4 mm. Both plates are in the form of a disc and have a through hole 6 in a central portion and a communication hole 7 and an inlet hole 8 in the peripheral portion as shown in FIG. 12. The first plate 4 and second plate 5 are integrally formed in the peripheral portion thereof with a plurality of crowns 60 (shown in FIG. 12). One of them is surrounding the through hole 6 and the communication hole 7, and another crown is surronding the inlet hole 8 and the others are located independently. The first plate 4 and the second plate 5 are connected at their ends to form a heat exchanging unit 9. Since the first plate 4 and second plate 5 are respectively formed at their opposed positions with the through hole 6, the communication hole 7 and the inlet hole 8, when a plurality of the heat exchanging units 9 are stacked, the through holes 6, the communication holes 7 and the inlet holes 8 are respectively brought into communication with each other to form a through passage 10, a communication passage 11 and an inlet passage 12, respectively as shown in FIG. 6.

Figure 3:
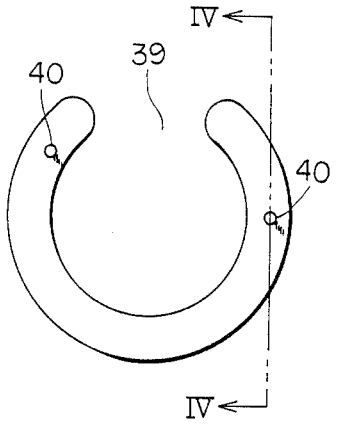
FIG. 3 is a front view showing a collar shown in FIG. 1.
Figure 4:
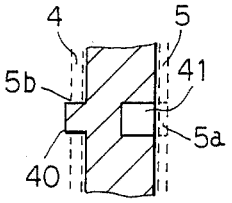
FIG. 4 is a sectional view taken on line IV—IV of FIG. 3.

A generally circular shaped collar 38 is disposed around the through hole 6, between the first plate 4 and the second plate 5 such that one surface of the collar 38 is in contact with inner surfaces thereof, and a ring 71 is also disposed around the communication hole 7 between the first plate 4 and the second plate 5 so as to be in contact with the inner surfaces thereof. As shown in FIG. 3, the collar 38 has a partially cut portion 39 which is open to the position substantially opposite the inlet passage 12. Thus, a first fluid, for example, engine oil, which flows into the heat exchanging unit 9 through the inlet passage 12 circumferentially flows within the heat exchanging unit 9 along the outer periphery of the collar 38 and then flows into the through passage 10 through the partially cut portion 39 of collar 38. As shown in FIGS. 3 and 4, the collar 38 is formed on its surface with engageable projections 40, and the surface opposite the engageable projection 40 is formed with an engageable hole 41. Since each of the first plate 4 and the second plate 5 is formed with holes at the corresponding portions to the engageable projections 40 of the collar 38, the collar is always positioned in place between the first plate 4 and the second plate 5. Therefore, the position of the cut portion 39 of the collar is registered and communicated with the through passage 10 of the heat exchanging unit 9 from the same position.

A seat plate 13 (visible in FIGS. 1 and 6) disposed on the upper surface of the heat exchanging unit 9 is formed from a stainless or iron plate. The seat plate 13 is also formed at a position corresponding to the heat exchanging unit 9 with a through plate hole 14, a communication plate hole 15 and an inlet plate hole 16. In the seat plate 13, especially the through plate hole 14 is a barring hole which is formed with a downwardly directed flange 17. A block 18 is disposed on the upper surface of the seat plate 13, and the upper portion of the block 18 is covered with a bottomed cylindrical upper case 19. The block 18 is formed at a position opposed to the communication hole 7 with a communication block hole 25 and formed at a position opposed to the inlet hole 8 with an inlet block hole 26. The open end of the upper case 19 is covered with a lower case 20, the upper case and lower case together constituting a closed space. Both the upper case 19 and the lower case 20 are formed from a stainless plate having a wall thickness of approximately 0.8 to 1.0 mm.

A retaining plate 21 (as shown in FIG. 1) interposed between the engine block 1 and the lower case 20 is formed of iron having a wall thickness of approximately 4 to 5 mm. This retaining plate 21 is peripherally formed with a groove 22 into which an O-ring 23 is fitted to provide sealing between the retaining plate 21 and the engine block 1. The retaining plate 21 is formed with an oil plate passage 24 which communicates with the oil flow passage 3 formed in the engine block 1 with the communication passage 11 of the heat exchanging unit 9.

Figure 2:
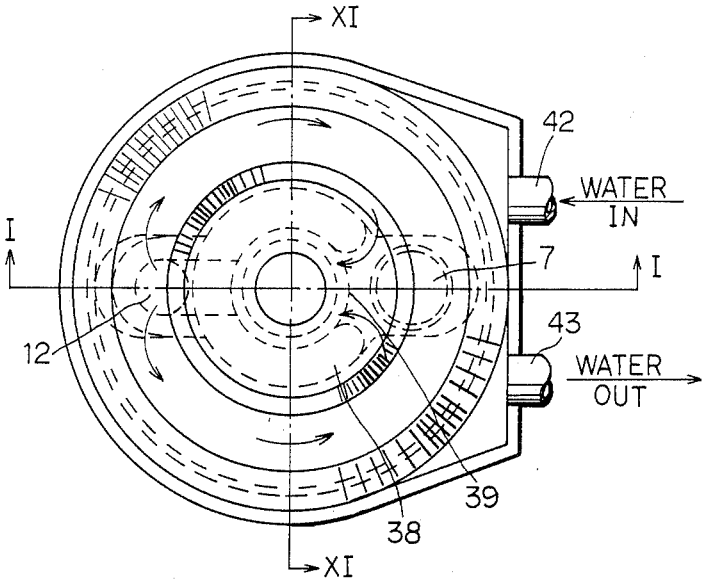
FIG. 2 is a top view of the heat exchanger shown in FIG. 1.

An inlet pipe 42 for introducing a second fluid, for example, engine cooling water, and an outlet pipe 43 for discharging the same are open to the upper case 19 as shown in FIG. 2. Engine cooling water of relatively low temperature after the radiator has been cooled is introduced by a motor pump not shown into the case through the pipe 42 and receives heat from the engine oil by the heat exchanging units 9, after which the water is discharged again on the side of the engine through the outlet pipe 43.

A filter washer 27 is disposed on the upper surface of the upper case 19 as shown in FIG. 6. This washer 27 is formed of stainless or iron, and a communication washer passage 28 is formed in a ring-like fashion. This communication washer passage 28 is communicated with the communication passage 11 of the heat exchanging unit 9, via a communication case hole 29 formed in the upper case 19. The communication washer passage 28 of the washer 27 is formed on the inner peripheral side thereof with a plurality of holes 30, through which engine oil flows toward the oil filter 35.

A through bolt 31 internally formed with an oil passage 32 extends through the washer 27, the upper case 19, the through plate hole 14 of the seat plate 13 and the through hole 6 of the heat exchanging unit 9. This through bolt 31 is formed at both ends with threaded portions 33 and 34, the lower threaded portion 33 being screwed into the tapped hole 2 of the engine block 1. On the other hand, the upper threaded portion 34 is screwed into the tapped hole (not shown) of an oil filter 35. The through bolt 31 is formed at its upper surface with inlet bolt holes 36 in communication with the inlet block hole 26 of the block 18, and the through bolt 31 is formed at its lower portion with holes 37 in communication with the through passage 10 of a plurality of the heat exchanging units 9.

Figure 5:
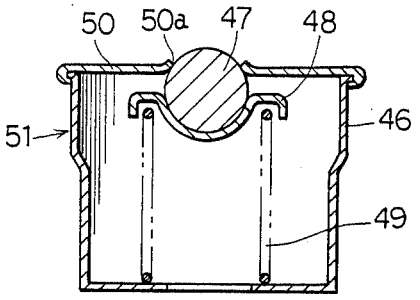
FIG. 5 is a sectional view showing a low pressure valve shown in FIG. 1.

A flange 31*a* is integrally formed with the through bolt 31 at a portion opposed to the seat plate 13 and a low pressure valve 51 as shown in FIG. 5 is pressed into the oil passage 32 of the through bolt 31. As shown in FIG. 5, the low pressure valve 51 consists of a steel ball valve 47, (having a diameter of 10 to 12 mm), a first valve case 46, a cover 50, a spring receiver 48, the steel ball valve 47 being biased by means of a spring 49 towards a case cover 50. Thus, when pressure of engine oil applied to the steel ball valve 47 exceeds contact pressure of the spring 49, the steel ball valve 47 opens the oil passage 32 of the through bolt 31.

Figure 7:
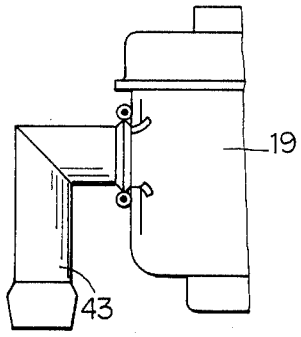
FIG. 7 is a front view showing the state wherein an upper case shown in FIG. 1 and a pipe are connected.

Next, the procedure for assembling the afore-mentioned oil cooler will be described. First, each of two thin plates made of brazing copper is disposed on each of the inner surfaces of the first plate 4 and second plate 5, the collar 38 coated with the brazing copper is disposed around the through hole 6, the ring 71 coated with the brazing copper is disposed around the communication hole 7, and inner fins 72 for enhancing heat transfer are interposed between both thin plates and under this condition, outer peripheral portions of both the plates 4 and 5 are connected by caulking. At this time, positioning is properly carried out since the collar 38 is formed with the engageable projection 40 and engageable hole 41 and the first plate 4 and the second plate 5 are formed with corresponding holes 4*a*, 5*a* around the through hole 6 so as to correspond to the engageable projection 40, the engageable projection 40 is thrusted its head out of the hole of the first plate 4 or the second plate 5 as shown in FIG. 4. in this manner, the heat exchanging units 9 are temporarity assembled. Then, as shown in FIG. 6, the retaining plate 21, lower case 20, spacer 44, heat exchanging units 9, seat plate 13, block 18, upper case 19 and washer 27 are successively stacked, which structure is temporarily pressed by a jig not shown. At this time, brazing copper are respectively interposed between the lower case 20 and spacer 44, between the spaces 44 and the heat exchanging unit 9, between a heat exchanging unit 9 and the next heat exchanging unit 9, between the heat exchanging unit 9 and the seat plate 13, between the seat plate 13 and the block 18, between the block 18 and the upper case 19, and between the upper case 19 and the washer 27. A brazing material is placed on the joined portion between the upper case 19 and lower case 20. As shown in FIG. 7, the pipes 42 and 43 are connected to the upper case 19 by caulking, and a brazing material is placed on the connected surface therebetween. Under that condition, said structure is charged into a vacuum furnace not shown, and the brazing material is molten within the vacuum furnace to braze each of the aforesaid structures. Between the thus stacked and brazed heat exchanging units 9 is formed a space through which a second fluid i.e. cooling water flows since the crowns 60 formed on the first plates 4 and second plates 5 are placed in contact with each other. More specifically, since other member for forming said space is not interposed between each of the heat exchanging units 9, the heat exchanging units 9 may be easily stacked and the durability of the heat exchanger can be enhanced.

On the other hand, the valve 47 made of a steel ball, a spring receiver 48 and the spring 49 are encased within the first valve case 46, under which condition, the case cover 50 constituting a valve seat is connected to the open end of the first case 46 by caulking to form the low pressure valve 51. The thus assembled low pressure valve 51 is pressed into and secured to the oil passage 32 of the through bolt 31.

After completion of brazing in the above-described steps, the through bolt 31 is inserted into the central through passage 10 of the heat exchanging units 9. The diameter of the through bolt 31 is substantially the same as the inside diameter of the flange 17 of the seat plate 13, and the O-ring 45 is interposed between the flange 17 and the through bolt 31 and therefore, sealing between the seat plate 13 and the through bolt 31 is positively maintained.

The thus assembled oil cooler is attached to the engine block 1 by screwing the threaded portion 33 of the through bolt 31 into the tapped hole 2 of the engine block 1. At this time, the fastening force of the bolt 31 is applied to the washer 27 of the oil cooler through the flange 31*a* formed integral with the through bolt 31. The fastening force is finally applied to each of the heat exchanging units 9. Therefore, each of the heat exchanging units 9 cannot sufficiently undergo said fastening force unless the units 9 is provided with sufficient load resistance, resulting in deterioration of durability. However, in the oil cooler of the present embodiment, the collar 38 is axially aligned and disposed on the portion opposed to the flange 31*a* of the through bolt 31, and therefore, the axial load applied to the heat exchanging unit 9 can be supported by the collar 38. Thus, it is possible to impart sufficient load resistance to the heat exchanging units 9.

Next, the operation of the above-described oil cooler will be described. The through bolt 31 fitted into this oil cooler is threaded into engine block 1. Engine oil from the flow passage 3 flows into the passage of the retaining plate 21, passes through a communication hole (not shown) of the spacer 44 from the hole provided in the lower case 20, and then flows into the communication passage 11 of the heat exchanging units 9. Engine oil having passed through the communication passage 11 flows into the communication washer passage 28 of the washer 27 from the communication plate hole 15 of the seat plate 13, the communication block hole 25 of the block 18, the communication case hole 29 of the upper case 19, and thereafter flows into the oil filter 35 from the holes 30 of the filter washer 27.

That is, engine oil introduced from the engine block 1 is not heat exchanged by the oil cooler but is directly introduced into the oil filter 35 through the above-described passage, in which filter, impurities such as iron powder contained in the engine oil are filtered out.

Engine oil filtered by the filter 35 thereafter flows into the oil passage 32 of the through bolt 31. When the low pressure valve 51 is closed, engine oil in the oil passage 32 flows into the inlet block passage 26 in the block 18 from the inlet bolt holes 36 and then flows into the inlet passage 12 of the heat exchanging units 9 from the inlet plate hole 16 of the seat plate 13. Engine oil is branched and flows into each of the heat exchanging units 9 from the inlet passage 12. In each of the heat exchanging units 9, engine oil flows along the outer periphery of the collar 38 and flows peripherally of the disc-like heat exchanging unit 9. At this time, the engine oil is heat exchanged by engine cooling water, which flows externally of the heat exchanging unit 9, and is cooled. Particularly, each of the heat exchanging units 9 is internally provided with the inner fins 72 to thereby facilitate heat exchange.

Engine oil cooled by the heat exchanging units 9 then flows into the central through passage 10 from the cut portion 39 of the collar 38, and engine oil from all the heat exchanging units 9 are gathered within the through passage 10, after which the oil again flows into the oil passage 32 of the through bolt 31 through the holes 37 of the through bolt 31. Again, engine oil is returned to the oil passage (not shown) within the engine block 1 from the passage 32.

Where the temperature of engine oil is relatively low in a winter season or the like, the viscosity of oil is also high and thus a great flow resistance sometimes occurs during the passage of the heat exchanging units 9. In such a case, circulation of engine oil is impaired, sometimes resulting in a possible poor operation of the engine. However, in the present embodiment, the low pressure valve 51 is provided, and therefore, when the flow resistance increases in the heat exchanging units 9, engine oil can be directly introduced into the oil passage 32 while bypassing the heat exchanging units 9. That is, when the flow resistance in the heat exchanging units 9 is fixed, pressure applied to the upper surface of the steel ball valve 47 exceeds piece pressure of the spring 49, and the passage 50*a* of the cover 50 is opened by the steel ball valve 47 by the aid of a differential therebetween.

Figure 8:
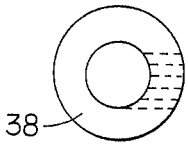
FIG. 8 is a front view showing a modified collar of the heat exchanger in accordance with the present invention.
Figure 9:
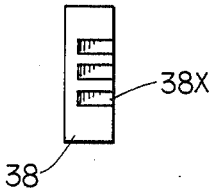
FIG. 9 is a side view of the modified collar shown in FIG. 8.
Figure 10:
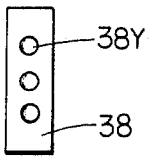
FIG. 10 is a side view showing a further modified collar of the present invention.

While in the above-described embodiment, the collar 38 is formed in a generally circulr shape with a cut portion, it will be noted tht the collar can be made to have a doughnut shape, a part of which is formed with a cut portion 38*x*, as shown in FIGS. 8 and 9. Alternatively, the collar can be made into a doughnut shape, a part of which is formed with a cut hole 38*y* as shown in FIG. 10. In the present invention, the generally circular shape includes the doughnut shape with such a cut and the aforesaid circular shape with a cut portion.

Next, another embodiment of the present invention will be described with reference to the FIGS. 12, 13, 14 and 15. While in the above-described embodiment, the first plate 4 and the second plate 5 is formed with the corresponding holes 4*a*, 5*a*, it will be noted that the first and second plates can be formed with a bent portion 80 (visible in FIGS. 12 and 13) at the edge of the through hole 6 thereof. Since the bent portions 80 are formed so as to contact with the edge of the collar 38, the positioning at the collar 38 is properly carried out. That is, the cut portion 39 of the collar faces toward the communication hole 7 and away from the inlet hole 8 so as to lengthen a flow path of engine cooling water flow the inlet hole 8 to the through hole 7. Moreover, a low pressure valve 51' is composed of a valve plate 73' formed with a valve hole 73*a*, a spring 49 supposed with a spring stopper 75 which is stopped by a snape ring 75 disposed in the oil passage 32, and the valve plate 73 is biased by the spring 49 towards the flange 52 of the through bolt 31. Thus, when pressure applied to the valve plate 73 exceeds contact pressure of the spring 49, the valve plate 73 opens the passage 32.

Moreover, while in the above-described embodiment, the heat exchanger of the present invention has been used as an oil cooler, it will be noted that the present invention can be also used for heat exchange of other fluids. For example, the present invention can be used for heat exchange of torque converter oil or the like.

Furthermore, while in the above-described embodiment, the low pressure valve has been provided, it will be noted that an opening and closing valve for opening and closing the oil passage 32 by detecting a pressure of engine oil.

As described above, in the heat exchanger of the present invention, the through bolt 31 is inserted into the through passage 10 of the heat exchanging units 9 and the fastening force of the through bolt is utilized to secure it. Since the collar 38 is disposed around the through hole 6 between the first plate 4 and the second plate 5 so as to be axially aligned and to correspond to the flange 31*a* of the through bolt 31, the load resistnce of the heat exchanging units 9 can be mterially enhanced. Moreover, in the heat exchanger of the present invention, the collar 38 is formed into the generally circular shape having the cut portion 39 which is positioned with respect to the through hole 6 to permit the introduction of the oil flown through the inlet hole 8 into the through hole 6, and therefore, a flow of the first fluid can be well guided by the collar 38. Furthermore, when the heat exchanging units 9 composed of the first and second plates 4, 5 integrally formed with the crowns 60 are stacked, no other member for forming a space through which the second fluid flows is present between each of the heat exchanging units 9, and therefore, the heat exchanging units 9 can be easily stacked and durability of the heat exchanger is enhanced.

What we claim is;

1. A heat exchanger comprising:

a plurality of heat exchanger units, each unit including a first plate and a second plate, each having a through hole in a central portion thereof and an inlet hole and a communication hole in a peripheral portion thereof, a ring positioned so as to be axially aligned with said communication hole and between said first and second plates so as to be in contact with the inner surfaces thereof, and a collar, disposed around said through hole between said first plate and said second plate such that one surface of said collar is in contact with an inner surface of said first plate and the other surface of said collar is in contact with an inner surface of said second plate, said collar being formed in a generally circular shape and having a cut portion, said first and second plates being assembled together with said ring and collar therebetween with corresponding holes of said plates being axially aligned, the cut portion of said collar being positioned with respect to said through hole to permit the introduction of a first fluid through said inlet hole into said through hole, said plurality of units being stacked with corresponding holes thereof being axially aligned, the first and second plates being shaped such that when said units are stacked a first space is defined between respective first and second plates of each unit through which a first fluid can flow and a second space is defined between adjacent units through which a second fluid can flow;

a case for enclosing said plural heat exchanging units and said second space;

a through bolt, having a flange portion, fitted into said through hole, said flange portion of said through bolt being axially aligned with said collar.

2. A heat exchanger according to claim 1 wherein said first plate and said second plate are respectively integrally formed with crown portions for defining said space through which the second fluid flows between each of the heat exchanging units when said plural layers of heat exchanging units are stacked, and wherein each unit further includes, between said first and second plates, plural fins for enhancing heat transfer between said first and second fluids.

3. A heat exchanger according to claim 2 wherein said crown portions are formed around said communication hole, through hole and inlet hole of said first and second plates.

4. A heat exchanger according to claim 2 wherein said crown portions are located independenty.

5. A heat exchanger according to claim 1 wherein said first and second plates are formed so as to include means for positioning said collr such that said cut portion thereof faces toward said communication hole and away from said inlet hole so as to lengthen a flow path of said first fluid from said inlet hole to said through hole.

6. A heat exchanger according to claim 1 wherein said first and second plates are formed so as to have means for positioning said units with respect to each other when they are stacked.

7. A heat exchanger according to claim 1 wherein said collar is coated with a material for brazing, and formed so as to have means for positioning the same such that said cut portion thereof faces said communication hole to be away from said inlet hole.

* * * * *